United States Patent [19]

Ohlson

[11] Patent Number: 4,621,559

[45] Date of Patent: Nov. 11, 1986

[54] DETONATION CHAMBER

[75] Inventor: Johnny Ohlson, Karlskoga, Sweden

[73] Assignee: Aktiebolaget Bofors, Bofors, Sweden

[21] Appl. No.: 688,389

[22] Filed: Jan. 2, 1985

[30] Foreign Application Priority Data

Jan. 2, 1984 [SE] Sweden ..... 8400003

[51] Int. Cl.[4] ..... F42B 33/00; F42B 33/06; F42D 5/04

[52] U.S. Cl. ..... 86/50; 109/1 S; 109/49.5; 150/52 H; 220/244; 220/435; 220/900; 428/911

[58] Field of Search ..... 86/1 B, 1 R, 50; 220/3, 220/436, 298, 244, 435, 900; 109/1 R, 1 S, 74, 49.5; 428/911; 150/52 H; 89/36.01, 36.17

[56] References Cited

U.S. PATENT DOCUMENTS

| | | | |
|---|---|---|---|
| 3,786,956 | 1/1974 | Tabor | 86/1 B |
| 4,027,601 | 6/1977 | Hickerson | 109/1 R |
| 4,055,247 | 10/1977 | Benedick et al. | 220/288 |
| 4,187,758 | 2/1980 | Petty | 86/1 B |
| 4,326,468 | 4/1982 | King et al. | 86/1 B |
| 4,437,382 | 3/1984 | Yerushalmi | 86/1 B |
| 4,478,126 | 10/1984 | Holmlund | 86/1 B |
| 4,478,350 | 10/1984 | Ohlsson | 220/436 |

*Primary Examiner*—Stephen J. Lechert, Jr.
*Assistant Examiner*—Howard J. Locker
*Attorney, Agent, or Firm*—Pollock Vande Sande & Priddy

[57] ABSTRACT

The present invention relates to a readily replaceable liner for a detonation chamber (1) intended to protect the inside of the chamber from damage when the detonation chamber is used for test firings of fragment-producing charges. The liner consists of a plurality of readily replaceable parts or sections of a few types. In the case of cylindrical detonation chambers (1), use is made primarily for protection of the mantle wall of the chamber of rectangular plates or cassettes (20) slightly cupped in one direction, which are held together by a special fitting (29) to mantle rings covering the inside of the detonation chamber wall (10). The joint between the various parts of the liner is such that a small amount of play or rattle exists between the parts. By this means, the liner is prevented from commencing to vibrate in phase with the chamber wall (10). The fundamental idea behind the invention is a readily replaceable liner capable of receiving fragments and in which only damaged parts need to be replaced.

6 Claims, 5 Drawing Figures

DETONATION CHAMBER

BACKGROUND OF THE INVENTION

The present invention relates to a container or chamber capable of containing pressure and fragments produced by an explosion such as a detonation or a deflagration.

Containers of this type are commonly known as detonation chambers. They are used to protect the surroundings by containment of critical manufacturing stages in the production of explosive substances, as test bunkers in test detonations of such substances and for testing of fragmentation weapons as well as for storage of explosive goods in general.

The detonation chamber designs available hitherto have virtually always consisted of solid concrete bunkers dug down into the ground. Certain primarily spherical, thick-walled steel structures are also previously known. The lack of lighter detonation chamber constructions is attributable to some extent to the difficulties in producing reliable strength calculation models. During the last few years, however, modern computer technology has enabled calculation programs to be compiled which make it possible to calculate the strength of multi-walled spherical and cylindrical bodies with a very high degree of accuracy. These calculation programs have opened up the possibilities for manufacturing light-weight detonation chamber designs the strength of which is known.

Some of such light detonation chamber designs are described in our Swedish patent application Nos. 80.06726-7, 81 05585-7 and 83 05758-8. The first of these describes a multi-shell construction with an outer and an inner shell of steel and an intermediate shell of a plastic material which prevents the two steel shells from vibrating in phase. This design has proved to completely fulfil everything it promises in terms of strength but it is difficult to manufacture and even more difficult to repair and therefore relatively expensive. Its low weight, however, makes it suitable for mobile use, e.g. for disarming the increasingly common terrorist bombs and for containing critical process stages in otherwise harmless chemical process plants. In this latter application, it is in fact often a matter of locating the detonation chamber at a height above the ground level that is dictated by the other conditions valid for the process plant.

The second of the aforesaid detonation chamber types is a cylindrical single shell construction with end pieces which have been strengthened in a special way. The third design is a partly double-shelled, preferably cyindrical detonation chamber, the inner complete shell of which is clamped at its end pieces between powerful support beams which are anchored inside the end pieces of its cylindrical outer shell. This design is relatively easy to manufacture and is also relatively easy to repair. The cylindrical inner mantle of the chamber is in fact that part which will be damaged in the first instance and this part can be replaced after the outer shell of the chamber has been divided straight across and pulled apart. The repair is then concluded by welding the outer shell together. Although such a replacement of the inner shell is relatively simple in theory it will nevertheless be a rather expensive and time consuming procedure, partly in view of all the qualified welding work involved.

The risk of damage to detonation chambers intended for test purposes originates primarily from firing of charges giving rise to fragments.

BRIEF DESCRIPTION OF THE INVENTION

The present invention relates to a sectioned, readily replaceable liner for a bursting chamber which is intended to receive the first jolt upon detonation of fragment-producing charges. The liner is divided into a plurality of readily exchangeable sections of different standardized forms and any sections damaged by fragments can easily be replaced. Assembled on site, the various liner sections form a connected lining which in a cylindrical detonation chamber completely covers at least the inside of the mantle surface of the detonation chamber, since it is the inside of the mantle surface that is exposed to severe fragment damage. The function of the liner is to protect the inside of the detonation chamber against damage by fragments. The liner sections can therefore be made of relatively inexpensive steel although their dimensions must be relatively thick to stop all fragments. All pressure stresses to which the detonation chamber is exposed will be absorbed by the ordinary walls of the chamber. Since the liner is not expected to absorb any pressure stresses there is no need for the liner sections to be butt attached within the chamber. On the contrary, it is advantageous if the liner sections are able to rattle slightly in their mountings since the occurrence of vibrations in the same phase as in the ordinary outer wall of the chamber and in the liner can thus be prevented.

In order to provide adequate protection against fragments, the individual liner sections must be fairly thick. At the same time, this implies that their length must be limited so the different pieces do not become impossible to handle without the use of cranes or other lifting devices.

In a particularly preferred embodiment of the liner according to the invention, the liner consists of a cylindrical detonation chamber comprised of a plurality of rectangular parts or cassettes, each slightly cupped in one direction, which when placed edge to edge to the side of each other form a mantle ring, the outside diameter being adapted to the inside diameter of the detonation chamber. The length of the mantle ring in the lengthwise direction of the detonation chamber and the width of the cassettes, and thus indirectly also their quantity in each mantle ring, is determined by the thickness of the liner since each cassette must not be so heavy that it cannot be handled manually. To hold the various cassettes together within the mantle ring the end pieces are provided with connecting rings or end piece irons by which the cassettes can be attached by means of pins or bolts. The connecting rings may be made in several parts joined together but each and everyone of them shall be able to function as a connected unit. The complete liner of the detonation chamber is thus formed by several consecutively disposed mantle rings of cassettes separated by connecting rings or end piece irons. For joining the cassettes and end piece irons together, it may be appropriate to provide the cassettes with protruding end piece flanges. In order for the joint between the end piece irons and cassettes not to be deformed by fragments and thus render removal of damaged cassettes more difficult, the joint between the end piece irons and cassettes should be protected by a protective section, for example a readily removable U-section which adjoins and is connected to the inside of the end piece iron.

The arrangement according to the invention has been defined in the accompanying claims and will now be described in greater detail and with reference to the accompanying figures.

DESCRIPTION OF THE PREFERRED EMBODIMENTS

Corresponding parts have been given the same reference designations in the different figures although they have been drawn in different scales.

Figure 1:
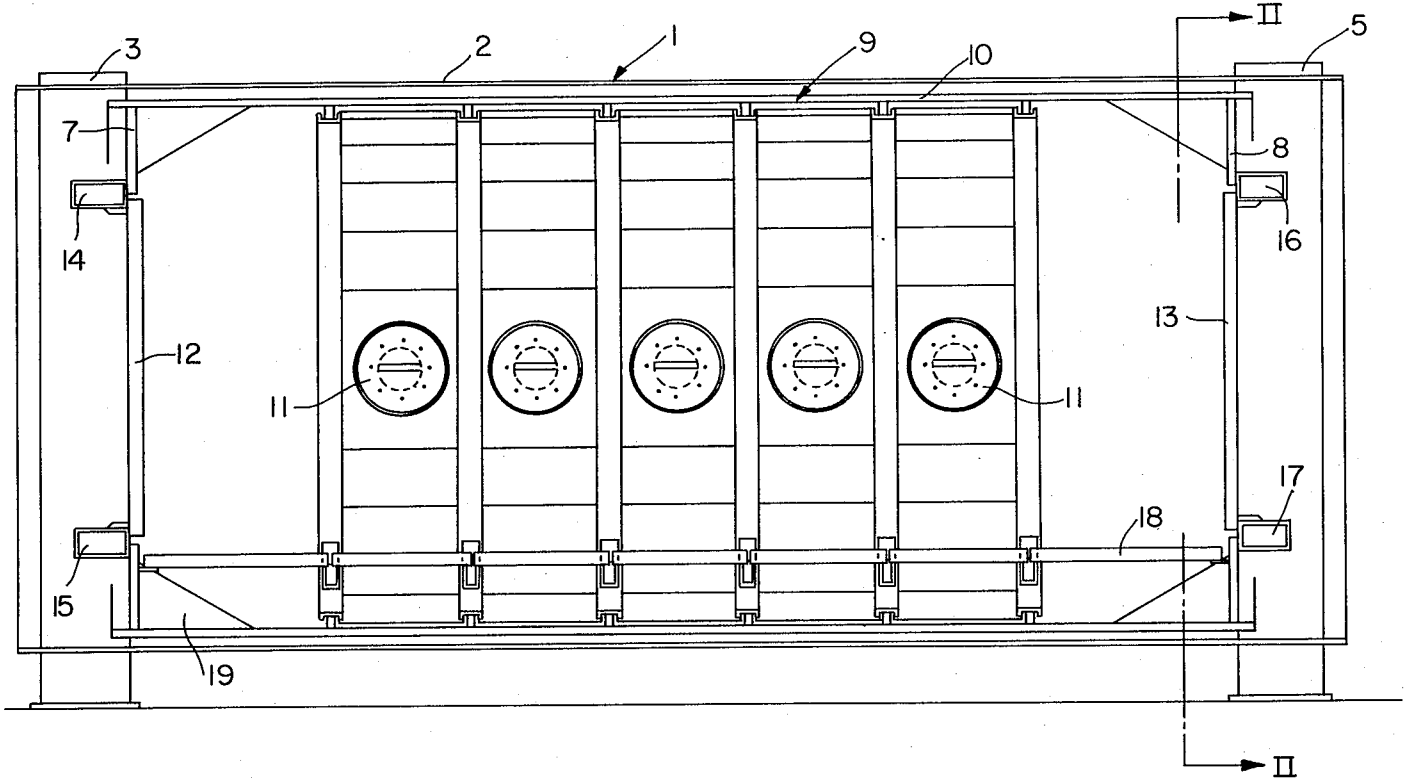
FIG. 1 shows a longitudinal section through a detonation chamber.
Figure 2:
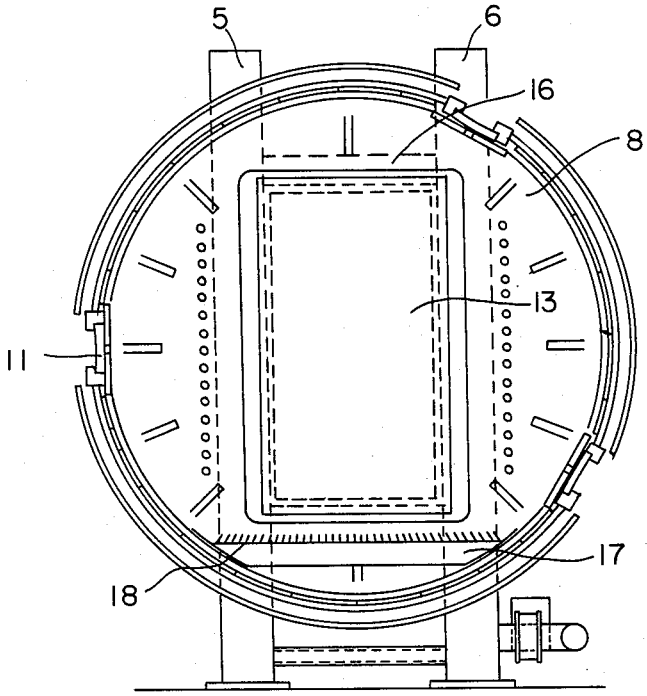
FIG. 2 shows a ??? taken along section II—II of FIG. 1.

The detonation chamber 1 shown in FIGS. 1 and 2 comprises a cylindrical outer shell surface (2) inside the ends of which are four stout beams (3–6). Beam (4) is not shown in these figures. The inner chamber (9) of the detonation chamber, which is closed at both ends by means of end pieces (7) and (8), is clamped inside and between these beams (3–6). In addition to end pieces (7) and (8) resting against the beams, this inner chamber consists of a mantle wall (10) in which there are a plurality of observation apertures (11).

Provided in the end pieces are doors (12) and (13) respectively. These doors open inwardly towards the chamber (9). They are supported by beams (3–6) and cross beams (14–17). Welded between the end pieces (7) and (8) and mantle wall (10) are a plurality of triangular reinforcement plates (19). In addition the detonation chamber is provided with a latticed floor plate (18).

The sectioned inner shell according to the present invention is disposed along the inside of the middle section of the shell wall (10) of the inner detonation chamber. The sectioned inner shell comprises rectangular plates or cassettes (20), slightly cupped in one direction, which are disposed in side by side relationship to form mantle rings which completely cover the inside of the mantle wall (10).

Figure 3:
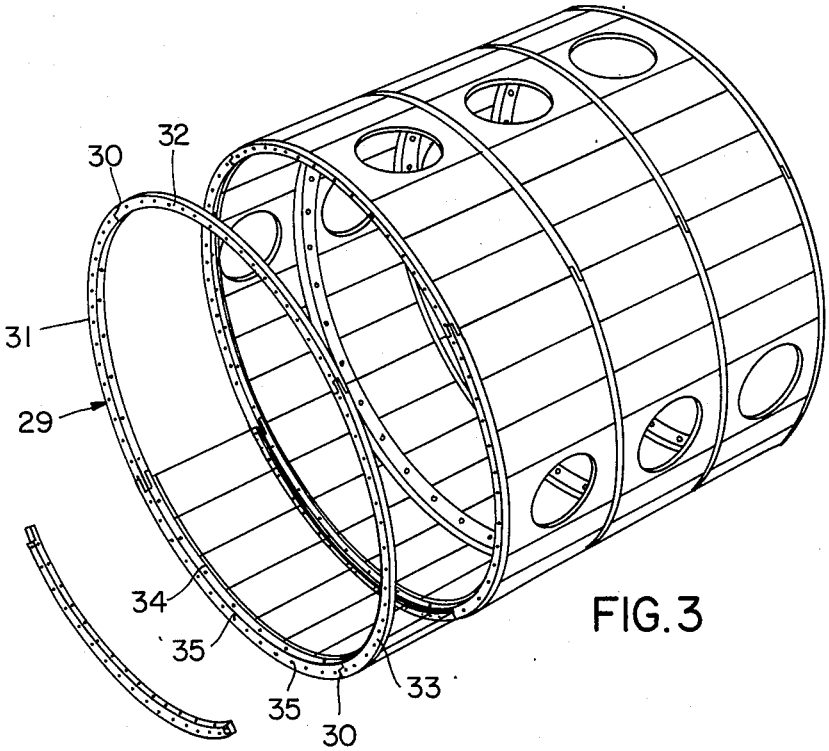
FIG. 3 shows an inclined projection of a part of the sectioned inner shell of the detonation chamber.
Figure 4:
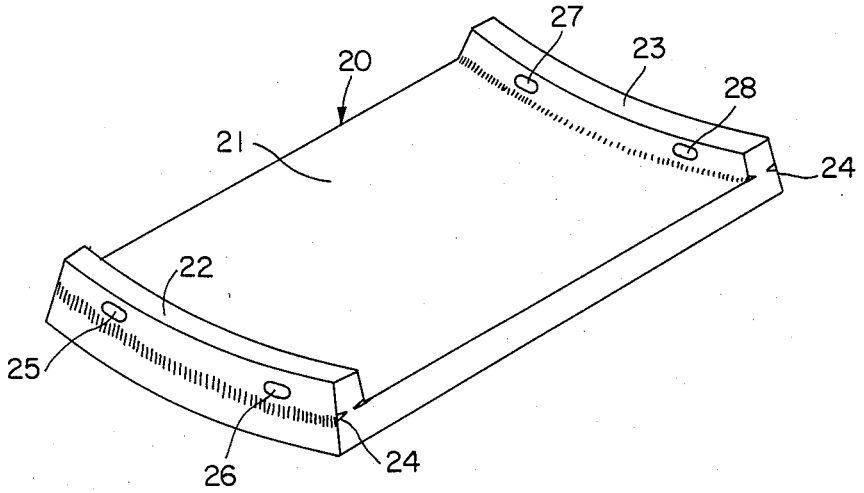
FIG. 4 shows an inclined projection in a larger scale of the cassettes of the inner shell and FIG. 5, shows a section in a larger scale across the joint between two adjacent mantle rings of cassettes and interlying ring-shaped fittings.

As is shown in FIG. 4, each cassette has a rectangular bottom part (21), which is slightly cupped along one axis, and two end pieces (22) and (23). The end pieces follow the curvature of the bottom section. The simplest way of manufacturing these end pieces is to preshape them and weld them on site. Each end piece features two or more throughgoing holes (25–28). The end pieces are welded to the respective bottom section throughout the length of their own joint (24). The end pieces (22, 23) of the cassette are applied to annular fittings (29) which are provided between the different mantle rings of cassettes. The fittings (29) may consist, as is shown in FIG. 3, of a plurality of parts (31–34) joined by bolts (30). In fittings (29) are a plurality of apertures (35), the spacing between which corresponds to the spacing between the holes in the end piece of the cassettes.

Figure 5:
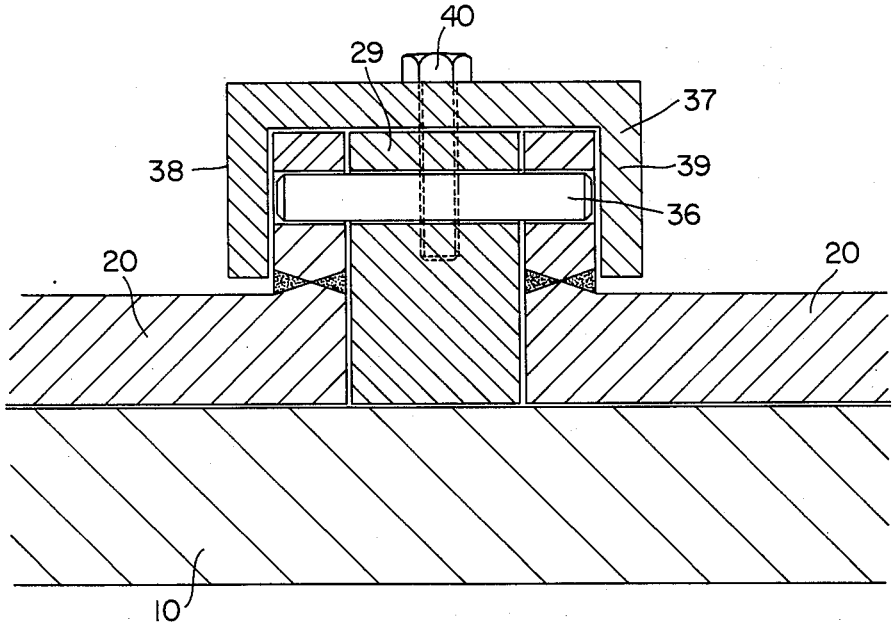

The cassettes (20) are joined together with the fittings (29) by means of smooth pins (36) (see FIG. 5) which are inserted through their respective holes. In addition, the joint between adjacent cassettes and interlying fittings is covered by a U-shaped protective rail (37) which is attached to the inside of the fitting and which extends with its flanges (38, 39) down past the apertures concerned to prevent the pins from falling out. The protective rail (37) is attached to its respective fitting (29) by means of bolts (40) threaded into it.

When joining the parts together, no absolute fit is required. It is an advantage of the invention if the parts are able to rattle in relation to each other in order to prevent vibrations in phase. The holes for pins and bolts can therefore be made slightly out of round.

Concerning the elaboration of the protective rails (37) it also applies that these grip across the end pieces (22, 23) of the cassettes (20), thus preventing these and the fittings (29) from sliding apart.

I claim:

1. Apparatus for containing high pressure and fragments produced by an explosion comprising:

an inner chamber having a cylindrical side wall and end walls closing said chamber, said side wall having an internal surface, an open-ended cylindrical outer shell surrounding said chamber and spaced from said cylindrical side wall of said inner chamber and a liner shell disposed inside said inner chamber and covering at least a central portion of said internal surface of said cylindrical side wall, said liner shell comprising a plurality of ring-shaped section members, said section members comprising a plurality of curved segments having inwardly projecting rims at each end, said segments further being positioned side by side and held together by a circular fitting member on said rims.

2. Apparatus according to claim 1 wherein said circular fitting member is divided into a plurality of parts joined together.

3. Apparatus according to claim 2 wherein said rims of said segments are provided with mounting means for attachment to said circular fitting member.

4. Apparatus according to claim 3 further comprising protective means attached to said fitting member to secure joining of said segments.

5. Apparatus according to claim 4 wherein said rims of said segments are provided with apertures and said fitting members are provided with corresponding apertures, said mounting means comprises pins to be inserted through said apertures in said rims and said corresponding fitting members, said protective means comprises a readily removable U-sectioned member applied on said pins to prevent them from falling out.

6. Apparatus according to claims 1 or 5 wherein said segments and sections of said inner lining are mounted to permit a small amount of movement between them.

* * * * *